US005314567A

United States Patent [19]

Noll

[11] Patent Number: 5,314,567

[45] Date of Patent: May 24, 1994

[54] MODULAR APPARATUS FOR PREPARING ARTICLES TO BE MAILED

[76] Inventor: Marvin H. Noll, 634 Lake Shore Dr., Parsippany, N.J. 07054

[21] Appl. No.: 60,741

[22] Filed: May 12, 1993

[51] Int. Cl.[5] ..... B43M 3/00

[52] U.S. Cl. ..... 156/441.5; 156/484; 156/485; 156/541; 156/542; 271/2

[58] Field of Search ..... 156/441.5, 442, 442.1, 156/442.2, 442.3, 247, 277, 384, 483, 484, 485, 540, 541, 542; 271/2

[56] References Cited

U.S. PATENT DOCUMENTS

| | | | |
|---|---|---|---|
| 2,346,142 | 4/1944 | Anderson | 156/483 |
| 3,245,859 | 4/1966 | Busk | 156/484 |
| 3,446,690 | 5/1969 | Charles | 156/446 |
| 3,721,601 | 3/1973 | Pituch et al. | 156/442 |
| 4,160,687 | 7/1979 | Spear | 156/444 |
| 4,473,429 | 9/1984 | Crankshaw | 156/483 |
| 4,601,771 | 7/1986 | Wesley | 156/447 |
| 4,850,580 | 7/1989 | Denzin et al. | 271/2 |
| 4,926,787 | 5/1990 | Fassman et al. | 156/441.5 |
| 5,118,375 | 6/1992 | Malachowski et al. | 156/216 |
| 5,122,108 | 6/1992 | Segalowitz et al. | 156/520 |

*Primary Examiner*—David A. Simmons
*Assistant Examiner*—William J. Matney, Jr.
*Attorney, Agent, or Firm*—Anthony J. Casella; Gerald E. Hespos

[57] ABSTRACT

A modular assembly of components is provided for various aspects of high volume mailing. The modular system of components includes a postage meter, having a base with a driving motor and a head driven by the driving motor and operative to apply selected postage to a piece of mail. The postage meter head can be selectively removed from the postage meter base. The modular systems of components further includes at least one accessory selectively mountable to the postage meter base and capable of being driven thereby. The accessory may include an applicator for applying a closure tab or label to an envelope or sheet of material being driven by the postage meter base. A closure tab applicator may be operative to move a closure tab into a position to be contacted by a sheet of material, such that momentum of the sheet of material causes the closure tab to wrap around and close the folded sheet. An alternate accessory may be a label applicator for applying a label to an envelope or sheet being driven by the postage meter base.

10 Claims, 3 Drawing Sheets

MODULAR APPARATUS FOR PREPARING ARTICLES TO BE MAILED

BACKGROUND OF THE INVENTION

1. Field of the Invention

The subject invention relates to apparatus employing a postage meter base to drive one or more modular components for applying closure tabs or labels to articles to be mailed.

2. Description of the Prior Art

Special purpose machines are available for virtually all tasks associated with mailing. For example, copy machines are available to photostatically copy material to be mailed and to collate the copies. Other special purpose machines are available to fold sheets of paper, while still other special purpose machines are available to insert sheets into envelopes. Special purpose machines are available to apply labels to envelopes or to sheets of paper, while still other special purpose machines are available to apply closure tabs across adjacent edges of a sheet to hold a folded sheet closed for mailing without an envelope.

Special purpose machines for many aspects of mass mailing typically are very expensive. Thus, only large volume mailers, such as banks, insurance companies, stock brokers and the like will own the dedicated machines to facilitate all phases of their mass mailing operations. Smaller businesses that do lower volumes of mailing often retain the services of mailing companies to assist in reproduction, folding, inserting, labeling, applying postage and/or actual mailing. However, mailing companies charge for their services, and thus the use of a mailing company generally imposes a cost penalty on the low to medium volume mailers.

Virtually all businesses own a photostatic copy machine and a postage machine. These universally available pieces of equipment may be suitable for certain parts of a business mailing, and the small business could utilize its own equipment to reproduce material to be mailed and to apply postage. However, other mailing tasks, such as applying labels or closure tabs might require a slow and inefficient manual process that diverts personnel for more productive activities.

Postage meters found in virtually all small businesses include a base and a head. The base includes an electric motor which operates mechanical components in both the base and the head. The mechanical components in the base drive material to be posted through the postage meter. The head typically is entirely mechanical and merely applies postage to the sheet material driven by the base. The head is removable from the base for periodic inspection and maintenance, and for application of postage.

A significant unmet need exists for office equipment that enables a small business to use automated equipment more efficiently for mailing or otherwise distributing material. For example, inexpensive equipment to apply closure tabs and/or labels could enable small businesses to perform significant mailings in-house, without the cost and inconvenience of diverting office personnel from more productive endeavors and without hiring outside mailing services.

In view of the above, it is an object of the subject invention to provide efficient apparatus for applying closure tabs and/or labels to material being mailed.

It is another object of the subject invention to provide apparatus which can be driven by available equipment in most offices for applying closure tabs and/or labels.

It is a further object of the subject invention to provide a modular assembly of office machines using a common drive mechanism with interchangeable heads for performing each of several optional office functions.

SUMMARY OF THE INVENTION

The subject invention is directed to modular apparatus for preparing material to be mailed. The modular apparatus includes a postage meter having a base and a head removably mounted to the base. The base includes a motor for driving components in both the base and the head. The apparatus further includes at least one alternate head removably mountable to the base and drivable by the motor of the base. For example, the alternate head may include means for applying closure tabs and/or labels to articles to be mailed. The tab and/or label applicator includes a supply of closure tabs and/or labels which may be mounted, for example, on carrier strips. The carrier strips may be transported from a supply reel to a take-up reel both of which may be removably mounted in the alternate head. Closure tabs and/or labels are sequentially driven into an appropriate location for application to sheet material being processed by the modular assembly comprising the postage meter base and the alternate head.

The modular apparatus of the subject invention may be used by removing the head of a postage meter from the base. The closure tab applicator or label applicator then may be securely mounted to the base for cooperation with the driving mechanism of the base. Thus, the base of an available postage meter is used to selectively apply closure tabs to sheets of material or to apply labels to sheets of material. After completing the application of closure tabs and/or labels to sheets of material, the closure tab applicator or the label applicator may be removed from the postage meter base, and the postage meter head may be remounted to the postage meter base for continued normal usage.

The closure tab applicator or label applicator may be sold separately for use with a postage meter owned or leased by a consumer. On the other hand, consumers may purchase or lease a modular assembly of components, including a postage meter base, a postage meter head, and one or more modular accessories, such as a closure tab applicator or a label applicator. The modular assembly may be reconfigured in accordance with a day-to-day mailing needs of the consumer.

DETAILED DESCRIPTION OF THE PREFERRED EMBODIMENT

Figure 1:
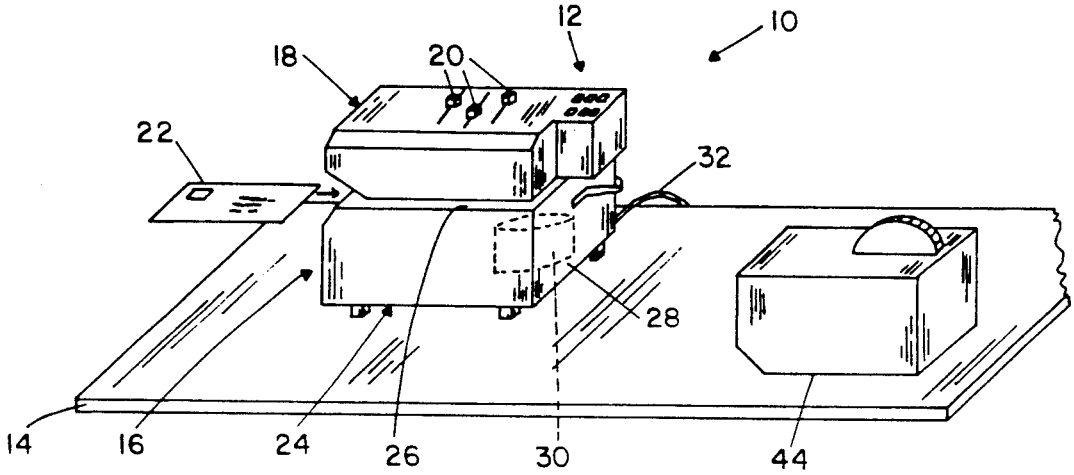
FIG. 1 is a perspective view of an assembly of modular components of the subject invention in a first optional configuration.
Figure 2:
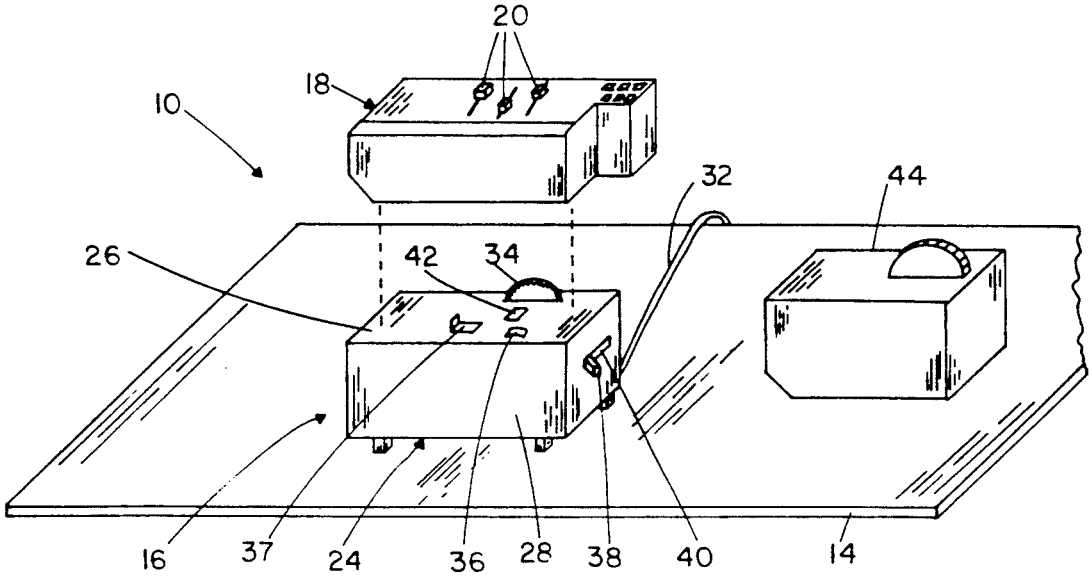
FIG. 2 is a perspective view of the components in FIG. 1 in their fully disassembled condition.
Figure 3:
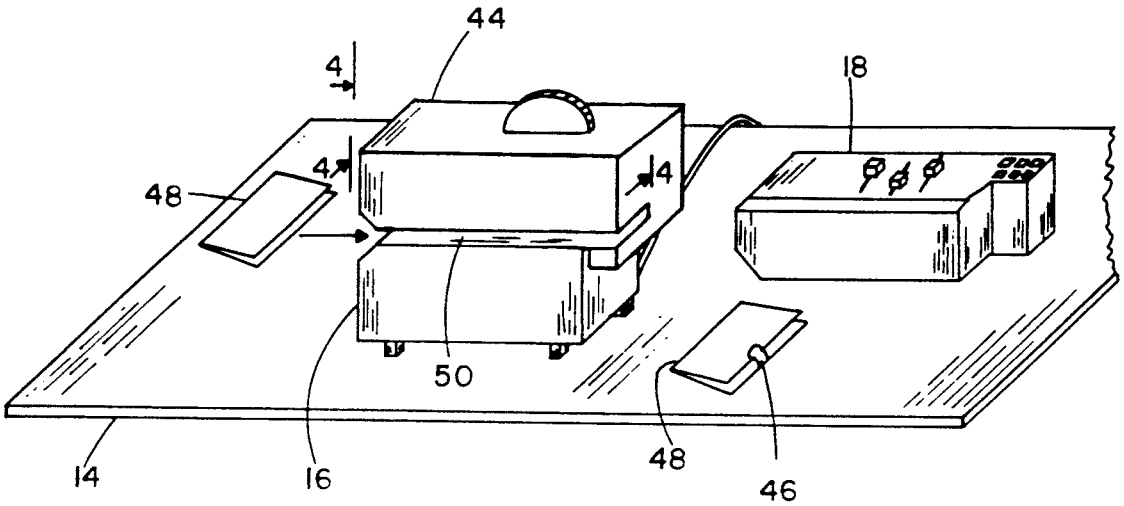
FIG. 3 is a perspective view showing the modular components in a second operational configuration.

An assembly of modular components in accordance with the subject invention is identified generally by the numeral 10 in FIGS. 1—3. The assembly of modular components 10 includes a postage meter 12 suitably dimensioned for mounting on a desk or table 14. The postage meter 12 of the modular assembly 10 may be similar or identical to meters manufactured by Pitney-Bowes, Freiden/Singer, Postalia or Hassler. The postage meter 12 includes a base 16 and a head 18. The postage meter head 18 includes levers 20 for selecting a desired amount of postage to be applied to an envelope 22. The postage meter head 18 is operative to print indicia on the envelope 22 corresponding to the postage selected with the levers 20. The printing is carried out by an adjustable printing head which is driven into contact with the envelope 22.

The postage meter head 18 is effectively a slave component driven by the postage meter base 16. More particularly, the postage meter base 16 includes a housing 24 having a top wall 26 and a plurality of side walls 28. An electric motor 30 is disposed in the housing 24 and is powered by electric current delivered through a conventional power cord 32. The motor 30 drives a gear wheel 34 which projects above the top wall 26 of the housing 24 of the postage meter base 16. The gear 34 is dimensioned and disposed to extend into the postage meter head 18 for driving the printing head to print indicia on the envelope 22. The motor 30 also operates a drive roller 36 for driving the envelope 22 through the postage meter 12. The motor 30 is actuated to drive the gear 34 and the roller 36 by a switch 37 which is triggered by insertion of the envelope 22 between the base 16 and head 18.

The postage meter base 16 includes a locking handle 38 projecting through a slot 40 in the side wall 28 of the housing 24. The handle is operative to rotate a lock 42 which projects above the top wall 26 of the housing 24 and which is engageable in a corresponding aperture of the postage meter head 18. In a rearward orientation of the handle 38, as shown in FIG. 1, the postage meter head 18 is lockingly engaged to the postage meter base 16. In a forward position of the handle 38, as shown in FIG. 2, the postage meter head 18 is selectively removable from the postage meter base 16. As explained above, removal of the postage meter head 18 from the postage meter base 16 may be required periodically for maintenance, for certification by postal authorities or for application of additional postage thereto.

The modular system 10 shown in FIGS. 1–3 further includes an applicator head 44 which can be selectively mounted to the postage meter base 16 after the postage meter head 18 has been removed therefrom. The applicator head 44 cooperates with the postage meter base 16 to apply a closure tab 46 to a folded sheet of material 48 as the folded sheet 48 is passed through the slot 50 between the postage meter base 16 and the applicator head 44. As explained further herein, the sheet 48 is initially placed into slot 50 in substantially the same manner as an envelope to which postage is being applied. The folded sheet 48 triggers the switch 37 to actuate the drive roller 36 and to rotate the gear 34 of the postage meter base 16 for operating the applicator head 44 as explained herein.

Figure 4:
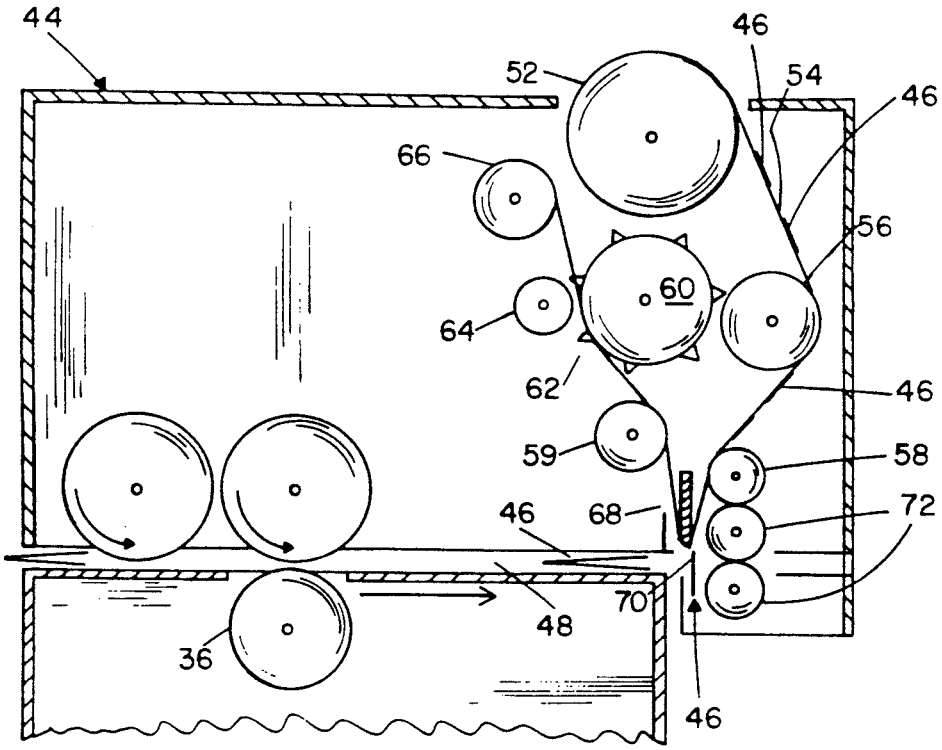
FIG. 4 is a cross-sectional view taken along line 4—4 in FIG. 3.

With reference to FIG. 4, the closure tab applicator head 44 includes a tab feed reel 52 on which a carrier strip 54 is stored. The carrier strip 54 transports a plurality of the closure tabs 46. The carrier strip 54 is transported around a take-up reel 56 and a guide wheels 58, 59 which are disposed in proximity to the slot 48. A pinwheel 60 has a plurality of circumferentially spaced pins 62 projecting therefrom. The pins 62 are dimensioned and spaced to engage corresponding apertures in the carrier strip 54 to enable precise incremental advancement of the carrier strip 54 as explained herein. The pinwheel 60 is rotatably driven by the motor 30 of the postage meter base 16. A guide wheel 64 guides the carrier strip 54 to a rewind reel 66.

A peel bar 68 is disposed intermediate the guide wheels 58 and 59 and defines an abrupt edge about which the carrier strip 54 must pass. In this regard, the carrier strip 54 undergoes close to a 180° change in direction in traversing the peel bar 68. As a result of this change of direction, each closure tab 46 traversing the peel bar 68 will continue substantially in a straight line defining a tangent extending from the guide wheel 58 to the peel bar 68. Hence, closure tabs 46 will separate from carrier strip 54 as the carrier strip 54 undergoes the substantially 180° in direction around the peel bar 68. The folded sheet 48 passing into the slot 50 will trigger the switch 37 and actuate the motor 30 of postage meter base 16 substantially in the manner as the envelope 22 having postage applied by the postage meter 12. The motor 30 will rotate drive wheel 36 and urge the sheet 48 through the slot 50. Simultaneously, the pinwheel 60 will be driven by the motor 30 to advance the carrier strip 54 incrementally and to urge one of the closure tabs 46 into the position shown in FIG. 4. More particularly, the closure tab 46 will be disposed in the slot 50 with its adhesive side 70 facing in a position to be engaged by the advancing folded sheet 48. The folded sheet 48 then will advance into the adhesive side 70 of the waiting closure tab 50. Momentum of the moving sheet 48 will cause the closure tab 46 to be folded around the sheet 48. The sheet 48 and the closure tab 46 will then be urged into the nip between former rollers 72, at least one of which is driven by the motor 30. Thus the closure tab 46 will adhesively engage the opposed edges of the sheet 48 for securely holding the sheet 48 in its closed folded condition.

Figure 5:
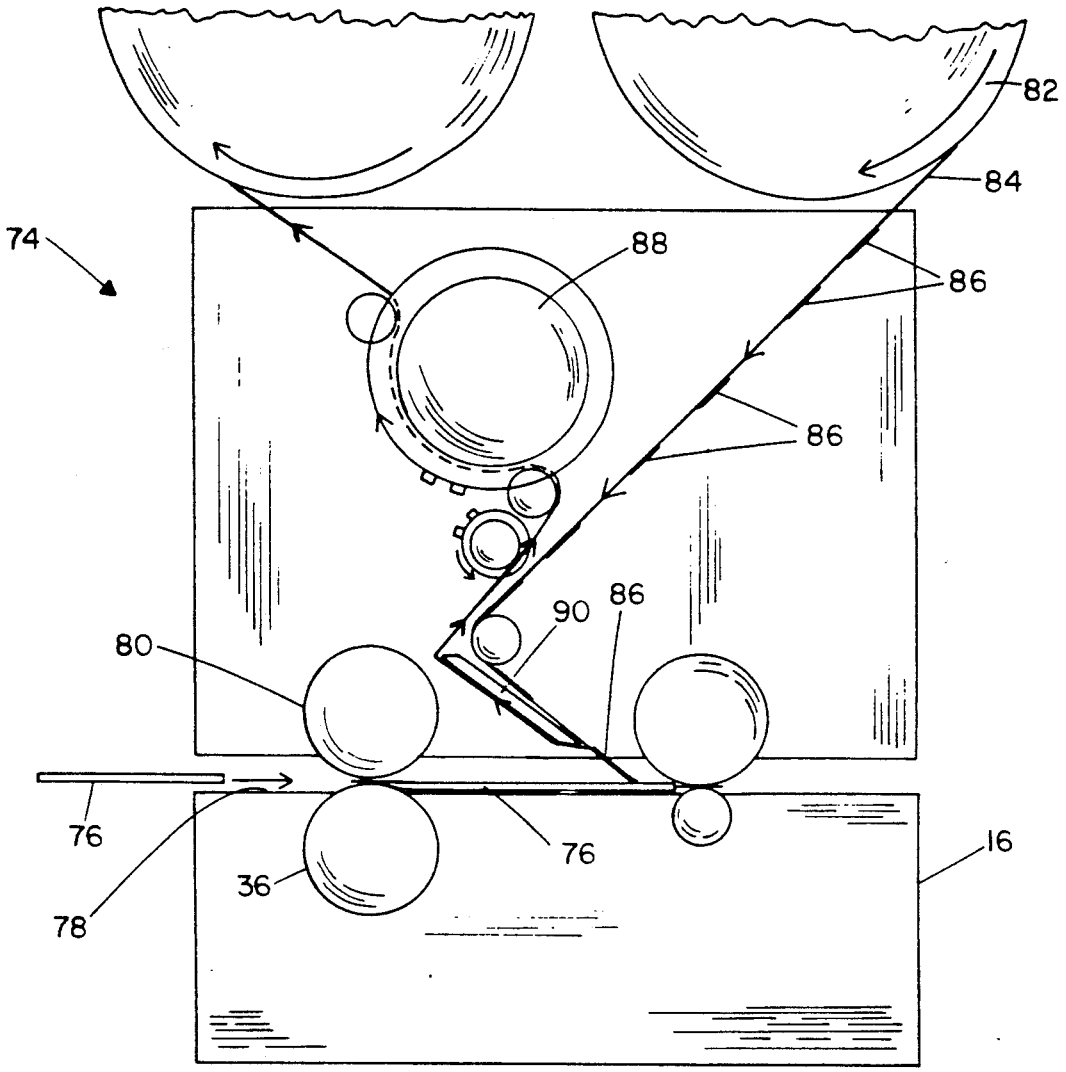
FIG. 5 is a cross-sectional view similar to FIG. 4 but showing a different operational configuration.

FIG. 5 shows an alternate applicator head 74 mounted to the postage meter base 16. The applicator head 74 is operative to apply labels to a sheet of material or an envelope 76 passing through a slot 78. As in the previous embodiment, the envelope 76 is driven by roller 36 in the postage meter base 16. The envelope 76 is guided against the drive roller 36 by an idler feed roller 80. A label reel 82 is mounted to the applicator 74 and delivers a carrier tape 84 with a plurality of labels 86 thereon. As in the previous embodiment, a pinwheel 88 is driven by the motor 30 in the postage meter base 16. The pinwheel 88 sequentially advances the carrier strip 84 sufficiently for moving a label 86 into a position for application to an envelope 76. More particularly, the carrier strip 84 passes around a peel bar 90 which causes the carrier strip 84 to undergo a substantially 180° change in direction. At this point, the label continues substantially linearly, as shown in FIG. 5, and is applied to the envelope 76 passing through the slot 78. Portions of the carrier strip 84 with the labels 86 removed are advanced to the take-up reel.

The applicator 44 or 74 can be selectively interchanged with the postage meter head 18 by merely moving the locking lever 38 into the forward position shown in FIG. 2 and lifting the head 18, 44 or 74 from the postage meter base 16. The replacement head can then be mounted onto the postage meter base 16 and locked in place by merely moving the lever 38 rearwardly. It will be appreciated, however, that other locking mechanisms may be provided to facilitate the selective interchanging of heads on the postage meter base.

While the invention has been described with respect to a preferred embodiment, it is apparent that various changes can be made without departing from the scope of the invention as defined by the appended claims. In particular, other configurations of postage meter heads and postage meter bases can be used with one or more applicator heads in accordance with the subject invention. In all such variations, the applicators are driven by the motorized postage meter base, and include locking and driving mechanisms compatible with a particular postage meter head and postage meter base.

What is claimed is:

1. A modular apparatus for preparing sheets of material to be mailed, said apparatus comprising:

a postage meter base having a motor, feed means operatively connected to said motor for sequentially feeding the sheets of material relative to said base and a driver operatively connected to the motor and projecting from said postage meter base;

a postage meter head removably engageable with the postage meter base, said postage meter head including adjustable printing means driven by said driver of said base for sequentially printing indicia on the sheets of material driven by the postage meter base; and at least one applicator head removably engageable with the postage meter base upon removal of the postage meter head therefrom, said applicator head being engageable with the driver of the postage meter base for selectively applying adhesive backed applications to the sheets of material driven by the postage meter base.

2. An apparatus as in claim 1, wherein the applicator head is a closure tab applicator and wherein the applications are closure tabs, said application head having a supply of the closure tabs and having means for sequentially moving the closure tabs into a position for engagement by the sheet of material driven by the postage meter base, whereby momentum of the sheet of material driven by the postage meter base is operative to cause said tab to fold around and close a selected portion of said sheet of material.

3. An apparatus as in claim 2, wherein the applicator head includes a pair of former rollers defining a nip therebetween, said former rollers being disposed for receiving the sheets and the folded closure tab in the nip for securing the closure tab to the sheet.

4. An apparatus as in claim 2, wherein the closure tabs are transported on a carrier strip, said closure tab applicator including a peel bar in proximity to a feed slot for causing the carrier strip to undergo a change in direction sufficiently great for sequentially separating each said closure tab adjacent said peel bar from said carrier strip.

5. An apparatus as in claim 4, wherein said closure tab applicator further includes a take-up reel for receiving portions of the carrier strip having the closure tabs separated therefrom.

6. An apparatus as in claim 1, wherein said applicator head is a label applicator and wherein said applications are labels, said label applicator having means for storing a plurality of the labels and means for sequentially applying labels to the sheets of material driven by the postage meter base.

7. An apparatus as in claim 6, wherein said means for storing a plurality of said labels includes a supply reel rotatably mounted in said label applicator, a carrier strip wound on said supply reel and carrying a plurality of said labels, a plurality of rolls for guiding said carrier strip and said labels into proximity to said postage meter base and a peel bar for redirecting said carrier strips sufficiently to cause said labels to be sequentially separated therefrom for application to the sheets of material driven by the postage meter base.

8. A tab applicator for securing opposed edges of folded sheets of material for mailing, said tab applicator being usable with a postage meter having a base with a motor, feed means operatively connected to said motor for sequentially feeding sheet material along a feed path adjacent said base and a driver operatively connected to the motor and projecting from the postage meter base, the tab applicator removably engageable with the postage meter base upon removal of a postage meter head therefrom including storage means for storing a plurality of adhesively backed closure tabs, delivery means driven by the driver of the base for sequentially delivering said tabs into said feed path for engagement by a folded sheet fed through the feed path by the feed means, and former rollers adjacent said feed path and downstream from said closure tab for securing said closure tab around the edges of said folded sheet fed by said feed means.

9. A tab applicator as in claim 8, wherein said closure tabs are releasably disposed on a carrier strip, and wherein said delivery means of said tab applicator comprises a plurality of rolls for guiding said carrier strip from said storage means toward said feed path, a peel bar adjacent said feed path for redirecting said carrier strip sufficiently to cause each said closure tab to sequentially separate from said carrier strip at said peel bar such that said carrier strip is directed away from said feed path and said closure tab is directed into said feed path for engagement by one said folded sheet driven by said feed means.

10. A label applicator for applying adhesive backed labels to sheet material, said label applicator being usable with a postage meter having a base with a motor, feed means operatively connected to said motor for sequentially feeding sheet material along a feed path adjacent said base and a driver operatively connected to the motor and projecting from the postage meter base, the label applicator removably engageable with the postage meter base upon removal of a postage meter head therefrom including storage means for storing a plurality of adhesively backed labels, delivery means driven by the driver of the base for sequentially delivering said labels into a position adjacent said feed path for engagement with sheet material passing through the feed path, and at least one roller adjacent said feed path and downstream from said labels for securely affixing said label to said sheet material.

* * * * *